United States Patent [19]

Fujita et al.

[11] Patent Number: 5,024,185

[45] Date of Patent: Jun. 18, 1991

[54] IGNITION DISTRIBUTOR OF INTERNAL COMBUSTION ENGINE

[75] Inventors: Yoshikuni Fujita; Haruyuki Matsuo, both of Himeji, Japan

[73] Assignee: Mitsubishi Denki Kabushiki Kaisha, Tokyo, Japan

[21] Appl. No.: 493,668

[22] Filed: Mar. 15, 1990

[30] Foreign Application Priority Data

Mar. 16, 1989 [JP] Japan ..... 1-29151
Mar. 16, 1989 [JP] Japan ..... 1-29152

[51] Int. Cl.[5] ..... F02P 7/02

[52] U.S. Cl. ..... 123/146.5 A; 123/647; 200/19 R

[58] Field of Search ..... 200/19 R; 439/544, 550, 439/552-556, 559-562, 565, 566; 123/146.5 A, 647

[56] References Cited

U.S. PATENT DOCUMENTS 3,888,225 6/1975 Boyer et al. ..... 123/146.5 A
4,125,103 11/1978 Jackson ..... 123/146.5 A
4,282,836 8/1981 Fox et al. ..... 123/146.5 A
4,463,715 8/1984 Brammer ..... 123/146.5 A
4,677,946 7/1987 Tamagne ..... 123/146.5 A

FOREIGN PATENT DOCUMENTS 3109606 10/1982 Fed. Rep. of Germany .... 200/19 R

*Primary Examiner*—Tony M. Argenbright
*Assistant Examiner*—Robert E. Mates
*Attorney, Agent, or Firm*—Sughrue, Mion, Zinn, Macpeak and Seas

[57] ABSTRACT

Leading means are disclosed for electrically connecting an electrical device contained in the housing of an ignition distributor of the internal combustion engine to the outside. A connecting section arranged in a location for contact with the terminal of the electrical device is electrically connected by means of a lead wire section to the connector section arranged in a through hole means defined by the housing. The above sections and the electrical device itself connected to the connecting section are rigidly constructed as an integral part by molding.

11 Claims, 4 Drawing Sheets

IGNITION DISTRIBUTOR OF INTERNAL COMBUSTION ENGINE

BACKGROUND OF THE INVENTION

1. Field of the Invention

This invention relates to an ignition distributor for an internal combustion engine (hereinafter referred to simply as distributor) and more particularly to the electrically connecting structure, in relation to the outside, of an electrical device housed in the distributor.

2. Description of the Related Art

Distributors containing such units as an ignition coil and an igniter within their housings are well known. FIGS. 1 and 2 are a vertical sectional view and a horizontal sectional view, showing structures of a section extending a lead wire in such conventional distributors for internal combustion engines. An ignition coil 2 and an igniter 3 are housed in a housing 1. Although not shown, a shaft rotating synchronously with the crankshaft rotation of the internal combustion engine is inserted and supported rotatably by a bearing in the housing. Further, a sensor device for detecting the angle of a crank is included so that a detecting signal is obtained by the rotation of the shaft.

The ignition coil 2 comprises a coil winding 21 of the primary side, a terminal 22, a lead wire 23 connecting the end of the coil winding 21 to the terminal 22 and a molded material 24 for embracing the above components and maintaining electric insulation. A coil winding of the secondary side is not shown. Two lead wires 6 consisting of flexible wires 6*a* and 6*b* run through a rubber bushing 5 in close proximity to the fitting section of the housing 1 for a distributor cap 4. Connecting pieces 62*a*, 62*b* are electrically connected and fixed to the flexible wires 6*a* and 6*b* by crimp-style terminals 61*a*, 61*b* within the housing 1. One end of the connecting piece 62 mates the terminal 22 of the ignition coil 2, making electrical connection to the coil winding 21. Although not shown in Figs., an electrically connected lead wire 63 through a crimp style terminal 61*c* is connected to the igniter 3. The lead wire 6 is provided with a connector 7 on the end thereof and the connector is fixed on the periphery of the housing 1 (not shown).

In a structure of the conventional distributor as described above, when assembling, the ignition coil 2 is housed in the housing 1, whereas the lead wire 6 is run through the rubber bushing 5 and then the connector 7 is fixed on one end of the wire 6 and the connecting piece 62 is fixed through the crimp-style terminal 61 on the other end of the wire 6. A connection is made by connecting the connecting pieces 62*a* and 62*b* to the terminals 22 of the ignition coil 2 as well as fixing the rubber bushing 5 to the housing 1.

The conventional distributor as constructed above has the following problems, that is, since the winding and the like of the ignition coil 2 are extended with the aid of the flexible lead wire 6, three crimp-style terminals are required, resulting in not only complicated and time-consuming assembly but many parts and increase in cost.

SUMMARY OF THE INVENTION

This invention overcomes the above described problems. It is therefore an object of the present invention to provide a distributor with simple assembly and fewer parts and which is not expensive.

In light of the above object, this invention is an ignition distributor of the internal combustion engine comprising:

a housing surrounding a shaft rotated synchronously with the crankshaft rotation of said engine, said housing containing at least one electrical device including terminals for an ignition coil, an igniter, a detector for rotation angle and the like;

through hole means provided on said housing for electrically connecting said electrical device to the outside of said housing; and leading means including at least one connecting section connected electrically to said electrical device, a connector section arranged in said through hole means defined on said housing, a lead wire section connecting electrically said connecting section and said connector section, and a mold section defined as an integral part rigidly by molding of said connecting section, said connector section and said lead wire section together with or without at least one of said electrical devices.

The distributor according to this invention includes the leading means where an electrical connection between the electrical device housed in the housing and an external device is made. That is, the connecting section arranged on the terminal of the electrical device is electrically interconnected in the leading means to the connector section arranged in the through hole means within the housing. The leading means is also rigidly defined by molding to embrace the above components as well as the electrical device itself as a whole.

These and other objects of the invention will become apparent by reference to the Description of the Preferred Embodiment, taken in connection with accompanying drawings.

DESCRIPTION OF THE PREFERRED EMBODIMENTS

Figure 1:
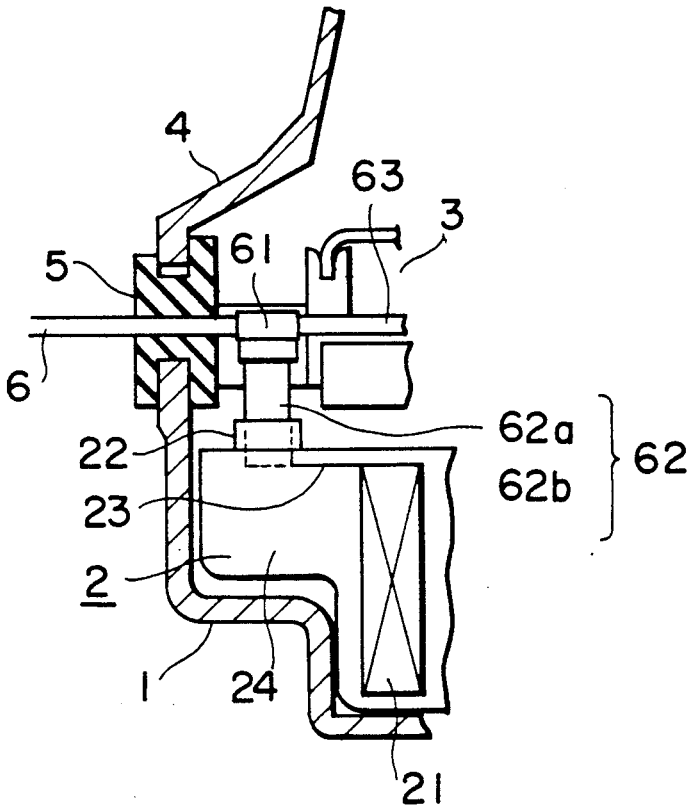
FIG. 1 PRIOR ART
FIG. 1 is a vertical sectional view showing the main structure of the subject portion of the conventional distributor.
Figure 2:
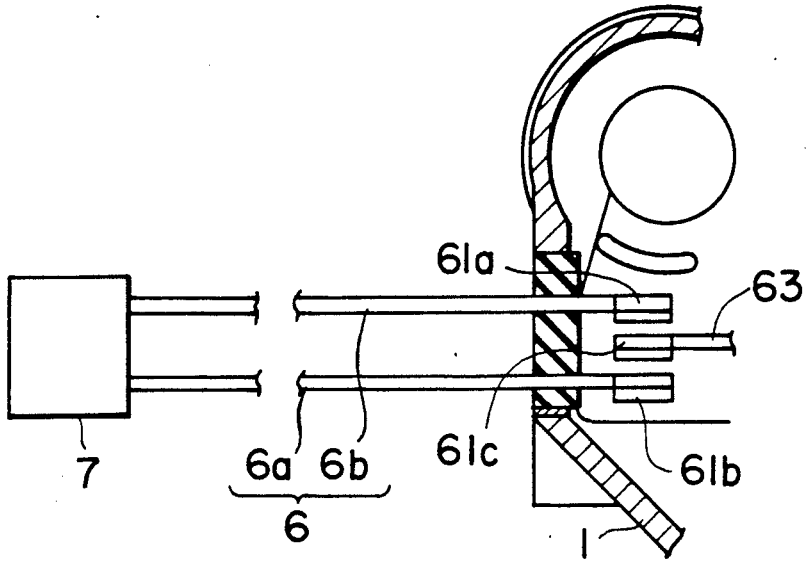
FIG. 2 PRIOR ART
FIG. 2 is a horizontal sectional view illustrating the major components of the distributor of FIG. 1.
Figure 3:
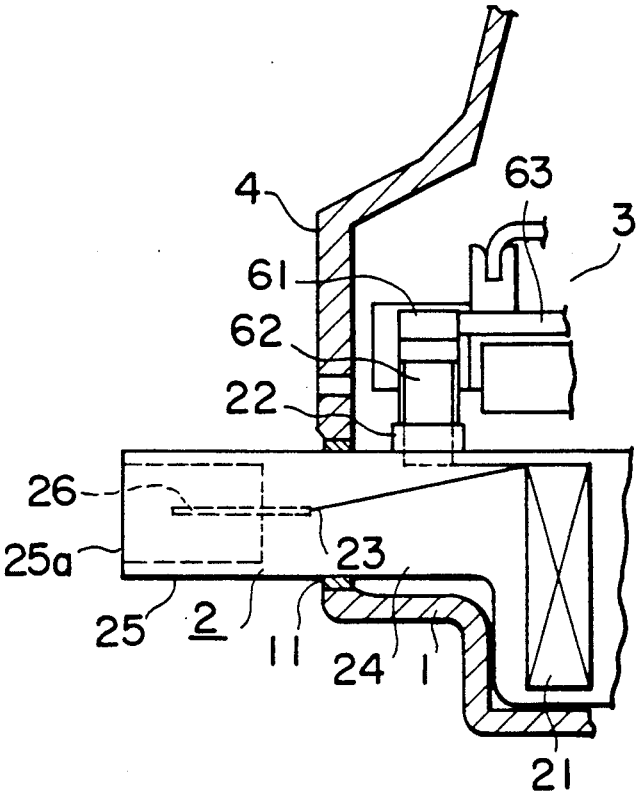
FIG. 3 is a vertical sectional view showing the subject structure of the distributor according to an embodiment of this invention.
Figure 4:
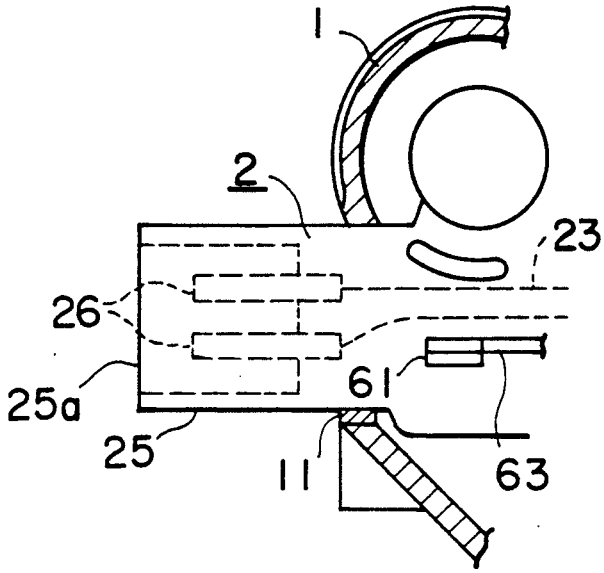
FIG. 4 is a horizontal sectional view depicting the major components of the distributor shown in FIG. 3.

An embodiment of the present invention will be hereinafter described with reference to the drawings. As shown in FIGS. 3 and 4, the ignition coil 2 is arranged, as an integral part, so that the molded material 24 encircling the cold winding 21 includes a connector section 25. A contacting piece 26 is already embedded in the connector section 25. The end of the contacting piece 26 is connected to the coil winding 21 via the lead wire 23 before molding. The lead wire 23 is therefore embedded in the mold material 24 as a part thereof. The housing 1 is further provided with through hole means 11 to extend the coil winding of the ignition coil 2 and the like out of the housing 1 so that the connector section 25 runs through the through hole means 11 and one part thereof farther projects therefrom. The explanations of the other reference characters are omitted because they are the same as those shown in FIGS. 1 and 2.

An integral formation of the connector section 25 and the coil winding 21 according to this invention as constructed above decreases connecting points of a crimp-style terminal and extremely simplifies assembling and connecting operations. As a result of the above, only one crimp-style terminal demanding time and effort is enough as shown in FIG. 4. Further, since the connector section 25 is directly fixed to the housing 1, it is not necessary to extend the connector out of the housing 1 to fix it at an appointed location. The effect of the invention in practical use is extremely remarkable. An inexpensive and highly reliable distributor is consequently available.

Although the connector 25 is projected outside of the housing 1, it may be arranged to any locations as desired. For example, the connector may be disposed backward toward the housing 1 so that the end portion 25*a* of the connector section 25 substantially meets the periphery of the housing 1. It is also expected to achieve the same effect as the above embodiment in the case where a sensor for detecting rotation and an igniter are not contained in the housing 1. The crimp-style terminal 61 is not always required. Further, connecting methods and the number of contacting pieces are not limited to the above described embodiment.

As described above, according to the aforementioned embodiment, the housing is provided with the through hole means and defined as an integral part by the molding together with the connector section to electrically connect the ignition coil and an external circuit. Owing to the construction of the connector section arranged in the through hole section, the distributor with fewer parts, simpler assembly and inexpensive in production is available.

Figure 5:
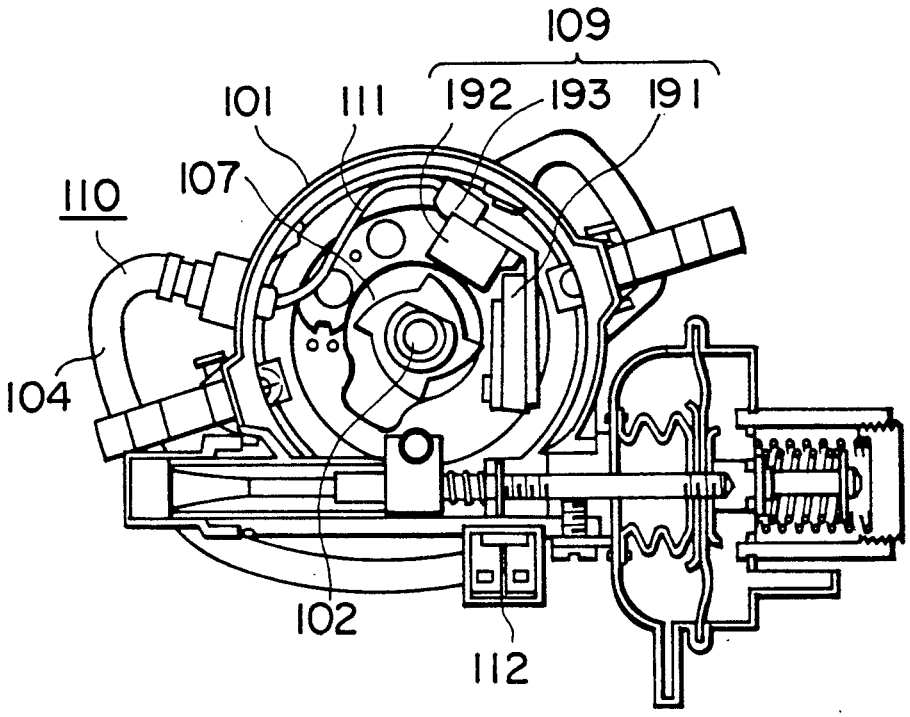
FIG. 5 PRIOR ART
FIG. 5 is a plan view showing the inside of another conventional distributor.

FIG. 5, for example, illustrates the inside of another conventional distributor shown in "Structure of Automobile Electrical Equipment", by The Association of All Japan Automobile Maintenance and Repair Schools, Sankaido Company, the First Impression of the Revised edition, Mar. 30, 1988. An overall description for FIG. 5 is omitted. Within the housing 101, an electrical device 109 serving as a magnetic detector including a magnet 191, a pick-up coil 192, etc. for rotation angle are arranged in an opposite direction to a timing rotor 107 rotating with the same axis as a shaft 102. The output signal of the pick-up coil 192 is led out of the housing 101 through leading means 110. The leading means 110 include a protective tube 104 and a flexible conductor 111, and one end thereof is connected to a terminal 193 and the other to a connector section 112 to which the flexible conductor 111 is connected through the protective tube 104. Although not shown, other electrical devices such as an igniter, an ignition coil, etc. are arranged in the housing 101.

The conventional distributor as constructed above has, for example, the following problems: the use of the flexible conductor 111 as the extending means 110 may swing and is not rigid within the housing 101, resulting in a crack, disconnection and so on by interference with other parts. Because of many parts, it takes time to thrust lead wires to various electrical devices.

In the distributor of another embodiment according to the present invention, through hole means as well as leading means having the through hole means through which a connector section is defined is arranged in the housing. The section including from the connector section and the terminal of the electrical device is defined, as an integral part, by molding. Thus, the whole components are rigidly fixed, simplified in assembly and less interfered with other parts.

Figure 6:
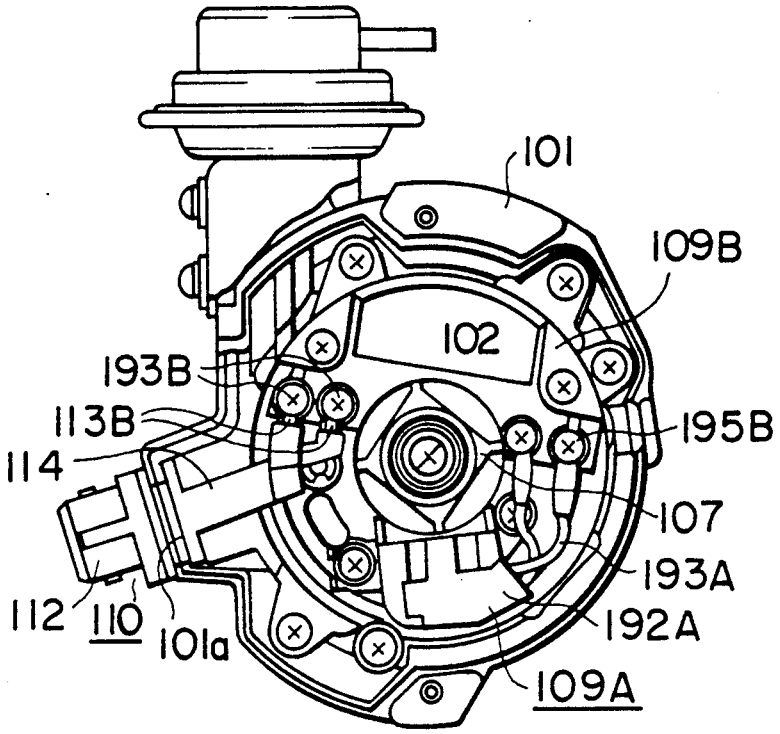
FIG. 6 is a plan view illustrating the distributor with the distributor head thereof removed according to another embodiment.
Figure 7:
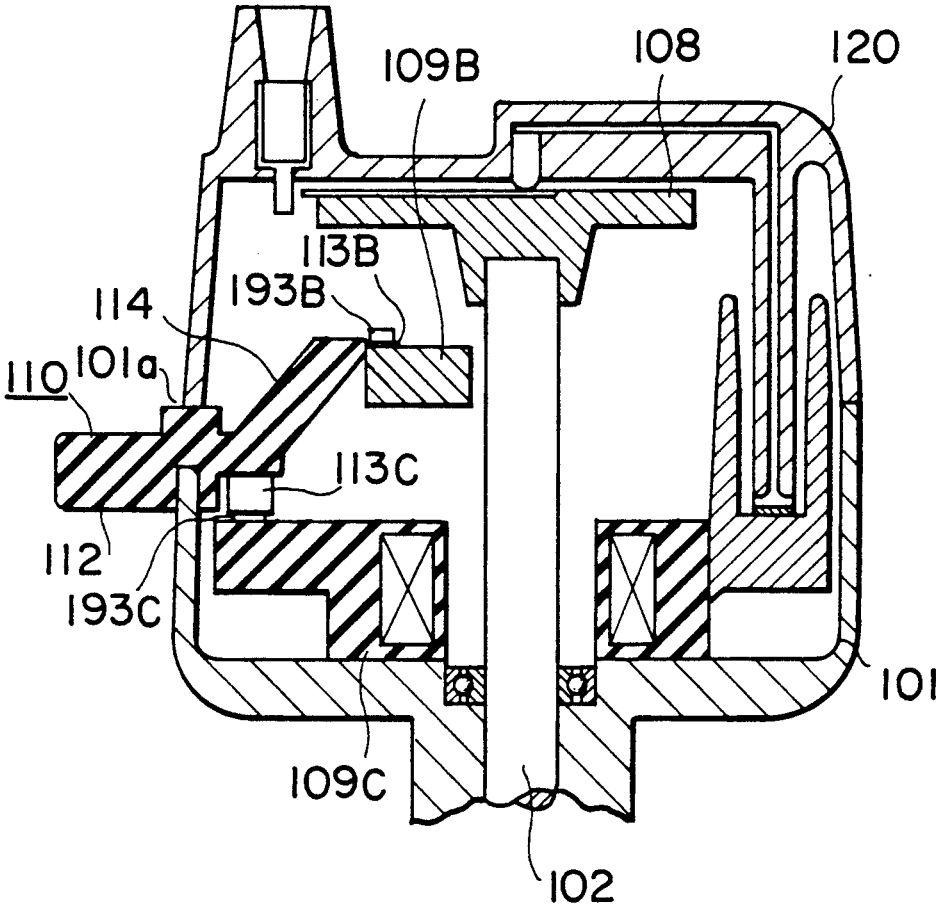
FIG. 7 is a sectional side view showing the major components of the embodiment shown in FIG. 6.

Another embodiment of this invention will be described in connection with drawings. As shown in the embodiment of FIGS. 6 and 7, the housing 101 contains a second electrical device 109B having an igniter and a third electrical device 109C (see FIG. 7) having an ignition coil, other than a first electrical device 109A having magnetic detector with a magnet (not shown), a pick-up coil 192A and the like for rotation angle. The output terminal 193A of the pick-up coil 192A is electrically connected to the input terminal 195B of an igniter 109B. The leading means 110 are so arranged that one end thereof is connected to a connecting section 113B for the output terminal 193B of the igniter 109B and a connecting section 113C for the terminal 193C of the ignition coil 109C is arranged at the center of the leading means 110 (see FIG. 7). A connecter 112 fixed to through hole means 101*a* of the housing 101 is disposed at the other end of the leading means. The space between the ends of the means is shaped as a whole by molded coating from molding. The through hole means 101*a* is an opening formed in an engagement portion where the housing 101 and the distributor cap mate. When assembling, only by fixing the leading section 110 downward as shown in FIG. 7, mating the connector section 112 with the through hole means 101*a* and the connecting section 113C for the terminal 193C on the ignition coil 109C is allowed, a location for the connection section 113B for the terminal 193B on the igniter 109B is determined. The connecting section 113B is then fixed by fixing means such as a screw to the terminal 193B. The terminal 193C on the ignition coil 109C is connected by spring force to the connecting section 113C (not shown). Further, it is needless to say that the conductor is appropriately connected or branched within the extending means.

As is clear from the description of the above structure, in this embodiment, when assembling, the leading means 110 is fitted to the through hole means 101*a*, while mating simultaneously the connecting section 113C with the terminal 193C so that the location for the terminal 193B automatically corresponds to that of the connecting section 113B. The connecting section 113B and the terminal 193B are then fixed by such means as a screw. This completes the connection. Therefore, easy assembling is made, giving an advantage of assembly automation. Since the conductor connecting the connector section 112 and the terminals 193B, 193C is rigidly constructed by the molded coating 114 of an insulating material, it resists vibration and interferes less with other parts, thereby preventing such problems as a crack and disconnection of the leading means. As a consequence, a highly reliable distributor is available.

The description is made in the above embodiment for housing 101 containing three electrical devices 109A, 109B and 109C having the detector for rotation, the igniter and the ignition coil. The embodiment, however, is not limited to the above scope. The same effect of the embodiment as described above will be achieved, provided that the housing contains suitable one or more electrical device. That is, the leading means 110 do not necessarily have two connecting sections 113B, 113C and accepts one or more than two. Although the through hole means 101*a* is arranged in the concave location of the housing 101, the location may be provided on booth the housing 101 and the distributor cap 120.

As described in the embodiments shown in FIGS. 6 and 7, the leading means are arranged where one end thereof is the connecting section electrically connected to the terminal of the electrical device and the other end thereof is the connector section arranged in the through hole means of the housing. The leading means are so constructed as to form these ends by molded shaping as an integral part, resulting in unnecessary extension of lead wire, less interference with other parts and elimination of such problems as a crack and disconnection. It is therefore possible to provide a highly reliable and easy-to-manufacture distributor.

What is claimed is:

1. An ignition distributor for an internal combustion engine, comprising:

a housing surrounding a shaft synchronously rotatable with a crankshaft of said engine, said housing containing at least one electrical device including terminals for an ignition coil, an igniter, and a rotational angle detector;

means defining a through hole in said housing for electrically connecting said electrical device therethrough to the outside of said housing; and leading means including at least one connecting section connected electrically to said electrical device, a connector section arranged in said through hole defined in said housing, a lead wire section electrically connecting said connecting section and said connector section, and a mold section defining a rigid integral part by molding together said connecting section, said connector section and said lead wire section.

2. A distributor according to claim 1, wherein said leading means include said connector section arranged in said through hole means of said housing, said connecting section arranged in a location for contact with a terminal of one electrical device when said connector section is fixed to said through hole means, said lead wire section to connect electrically said connecting section and said connector section, said mold section rigidly forming the above sections as an integral part by molding, said distributor further comprising fixing means for fixing said connecting section of said leading means to said terminal of said electrical device.

3. A distributor according to claim 1, wherein said leading means include said connector section arranged in said through hole means of said housing, a plurality of said connecting sections arranged in a location for contact with the terminals of each said electrical device respectively when said connector section is fixed to said through hole means, said lead wire section to interconnect electrically said connector section and a plurality of said connecting sections, said mold section rigidly forming said connecting sections, said connector section and said lead wire section, respectively, as an integral part by molding, and fixing means for fixing said each connecting sections of said leading means to said terminal of each electrical device, and when said connector section of said leading means is fixed to said through hole means, the locations for each connecting section with respect to said terminals of said electrical device are automatically determined, thereby fixing said each connecting section to said terminal by said fixing means.

4. A distributor according to claim 3, wherein a plurality of said electrical devices are ignition coils and igniters.

5. A distributor according to claim 1, wherein said leading means include a connector section arranged in said through hole means, a lead wire section to connect electrically said connector section and a terminal of one of said electrical devices and a mold section to rigidly form said electrical device, said connector section and said lead wire section as an integral part by molding.

6. A distributor according to claim 5, wherein said leading means further include at least one connecting section arranged in a location for contact with a terminal of another electrical device in said housing when said connector section is fixed to said through hole means, and a lead wire section for electrical connection to said connecting section.

7. A distributor according to claim 6, wherein said electrical device rigidly defined as an integral part by said connector section and molding is an ignition coil and another electrical device contained in said housing is an igniter.

8. A distributor according to claim 1, wherein said housing includes a distributor cap portion.

9. A distributor according to claim 8, wherein said through hole means fixing said connector section is arranged across said distributor cap portion of said housing.

10. A distributor according to claim 8, wherein said through hole means is an opening formed in an engagement location mating said distributor cap portion of said housing.

11. A distributor according to claim 1, wherein said connector section is fixed, projecting out from said housing.

* * * * *